US005479915A

United States Patent [19]

Riener

[11] Patent Number: 5,479,915

[45] Date of Patent: Jan. 2, 1996

[54] HEATING DEVICE FOR GASEOUS FUELS

[76] Inventor: Karl Riener, Müllerviertel 20, A-4563 Micheldorf, Austria

[21] Appl. No.: 206,744

[22] Filed: Mar. 4, 1994

[30] Foreign Application Priority Data

Mar. 8, 1993 [AT] Austria ..... 434/93

[51] Int. Cl.[6] ..... F24C 3/00

[52] U.S. Cl. ..... 126/512; 126/500; 126/502; 126/503

[58] Field of Search ..... 126/512, 500, 126/503, 502

[56] References Cited

U.S. PATENT DOCUMENTS 4,404,954 9/1983 Steel .
4,465,055 8/1984 Bortz .

FOREIGN PATENT DOCUMENTS 0102011 3/1984 European Pat. Off. .
3441896 8/1987 Germany .
2199654 7/1988 United Kingdom .
2208703 4/1989 United Kingdom .

*Primary Examiner*—Larry Jones
*Attorney, Agent, or Firm*—Collard & Roe

[57] ABSTRACT

A heating device for burning gaseous fuels comprises an inner shell (3) of U-shaped or C-shaped cross-section which defines a combustion chamber (9) which is bordered by a covering plate (5) and a floor plate (4), can be closed by a door arrangement (6). Gas burner assembly (13) is arranged on a burner base plate (12) and secured to the inner shell (3). Outer shell (2) of U-shaped or C-shaped cross section, on the floor plate. The outer shell (2) is arranged from the inner shell (3) at a distance forming an intermediate space (28). End edges of outer shell (2) and the inner shell (3) are welded together. Openings (27) are arranged in the inner shell between the combustion chamber (9)and the intermediate space (28) which forms a flue gas passage between the openings (27) and the flue outlet (44) region of the covering leading (44) to a smoke pipe connection piece (45). Sheet elements adjacent the outer shell form a convection channel with the outer shell.

19 Claims, 8 Drawing Sheets

1
18
19
52
31
41
28
3
30
45
46
III
39
29
20
44
22
54
27
53
63
40
21
51
2
42
23
24
26
25
6
43
9
12
13

HEATING DEVICE FOR GASEOUS FUELS

BACKGROUND OF THE INVENTION

1. Field of the Invention

The present invention relates to a heating device for gaseous fuels.

2. The Prior Art

A known heating device according to DE-A1-34 41 896 of the same applicant is produced in the form of a profile having a C-shaped or U-shaped cross-section and serving as a support module with a heating module disposed therein. This heating module, which forms the combustion chamber, consists of two profiles of which at least one has a cross-section that is substantially U-shaped. An air chamber, which is formed as a convection vault, is arranged between the heating module and the support module. In addition, a length of the profile of the support module is also exceeding that of a profile of the heating module. This design of a heating device makes it possible to produce the latter, in particular with single pieces consisting of bent sheet metal cuttings. Particularly the heating module can be produced from a tightly welded cube or a block-shaped component which, as a semi-finished product, can be inserted in one piece into the support module. In the front wall of the heating module suitable doors of a door arrangement are arranged in order to feed the combustion chamber with solid fuels. This type of design proved to be best for burning solid fuels, however, it is not suitable for use with gas stoves.

SUMMARY OF THE INVENTION

It is an object of the present invention to provide a heating device of the above mentioned type which makes it possible to put several profile pieces together to form a stove body, which is able to burn gaseous fuels, and furthermore, the heating device should have as large a surface as possible to give up the heat of the combustion chamber to the ambient air.

This object of the invention is achieved with a heating device for gaseous fuels, e.g. liquefied gas, comprising an inner shell of U-shaped or C-shaped cross section, the inner shell comprising a combustion chamber which is bordered by a covering plate located on the opposite side of the base plate, and can be closed in a front region opposite of the base of the inner shell by a door arrangement, and also a gas burner assembly which is arranged on a burner base plate and secured to the inner shell, and an outer shell of U-shaped or C-shaped cross section, the longitudinal axis of which is oriented vertically to a supporting surface of a floor plate and which rests with one of its faces on the floor plate, and that the outer shell is arranged from the inner shell at a distance forming an intermediate space in a direction perpendicular to the base or respectively a shank of the inner shell, and that the outer shell and the inner shell is connected to each other by means of a connecting device, at least in the region of the longitudinal front edges of the shanks, the connection device being a weld or a fusion of the latter with one another, and that in the shanks of the inner shell admission openings are arranged between the combustion chamber and the intermediate space which is enclosed by the inner and outer shell, said intermediate space forming a flue gas passage between the admission openings and the flue outlet is connected in the region of the covering sheet metal by a flue outlet to a smoke pipe connection piece, and said admission openings are arranged in particular between the longitudinal front edges and a separating profile, and in that sheetings are arranged upstream of the outer shell in the region of the two shanks and that between such sheeting and the outer shell a convection channel is formed. It is advantageous here, that by using two profiles with a U-shaped or respectively C-shaped cross-section, a supporting overall structure of a heating device can be achieved whereby the entire surface of the outer shell is able to give up heat to the ambient air or the convection air and that in spite of all that, a relatively small combustion chamber is sufficient. Additionally, by using the whole intermediate space between the inner shell and the outer shell, said space is available to carry away flue gases so that the strong heat energy of the gaseous fuel is fully utilized and an intensive temperature transfer from the flue gases to the ambient air can take place.

If the covering sheet metal is formed by a second shank of an L-shaped separating profile, the first shank of which is inserted between the shanks of the inner shell at a spacing from the base of the inner shell on the opposite side of the base of the outer shell, and connected in a smoke-tight manner to the shanks of the inner shell via a weld and extending downwardly in the direction of the floor plate, at least into the region of the burner base plate, an overheating, that is excessive thermal stress of the inner shell can be reliably prevented.

However, an embodiment wherein between the first shank of the separating profile and the base of the inner shell, which are running parallel to each other, a convection vault is formed which leads into a further convection vault between the other shank of the separating profile and a covering plate arranged at a distance thereabove, is also advantageous, because excessive thermal stress in the region of the rear wall of the combustion chamber or respectively of the convection vault formed by the outer and inner shell can be avoided by forming an additional convection vault between the rear wall of the combustion chamber and the inner shell, through which the air to be heated can pass, which, at the same time, causes a cooling down of the appropriate surfaces of the stove shell so that overheating of the latter may also reliably be prevented.

Another further development wherein a front edge associated with the door arrangement of the second shank of the L-shaped separating profile and the longitudinal front edges of the shanks of the inner shell and also a front edge of the burner base plate have a sealing device and allocated to these sealing devices a circumferential contact surface of a frame of the door arrangement, allows in a simple manner, without an additional fixing device, for the arrangement of sealing devices for a tight seal between the combustion chamber and the door arrangement.

In an embodiment wherein the base and the shanks of the outer shell are connected by transition pieces extending diagonally to them, provision is made that the length of stay or the flow path of the flue gases in the intermediate chamber can be easily adapted to the appropriate requirements.

An embodiment wherein at the extremities of the shanks facing away from the base in the direction of the longitudinal axis of the outer shell, extensions are arranged, facing one another and running inclined to said extremities, and which are preferably formed onto the outer shell in one piece, is also possible and allows for a direct connection between the outer and inner shell without the arrangement of any additional profiles. Moreover, thereby a one-piece outer shell can be produced.

In the case of an embodiment wherein a swivel pin of the bearing device of the door arrangement or respectively its frame is secured to these extensions, the disposition of the bearing device can facilitate the securing of the swivel pins of the bearing devices by the disposition of the extensions and an adaptation of the spatial position can be achieved.

A further development wherein the frame comprises a receiving flange for a heat resisting viewing window makes it possible to use the heating device as some kind of fireplace.

A further embodiment wherein holding devices are arranged on the outer shell at a distance from the shanks of the outer shell in order to secure the sheetings and that the air space between the sheeting and the shanks of the outer shell form a convection channel, is also advantageous, because thereby further convection channels can be arranged upstream of the outer shell which allows for an intensive thermal conduction between the flue gases and the room air flowing by outside. At the same time, this convection envelope achieves that the outer shell is not touched, which, due to the high calorific output of gaseous combustibles and thus high flue gas temperatures, reaches high surface temperatures.

A further development wherein the covering plate projects beyond the sheeting on the side facing away from the outer shell is also advantageous, because it allows for a diversion of the convection air in a purposeful manner.

An appropriate design of the base plate of the burner in accordance with safety regulations and quick assembly or replacement during maintenance is achieved by a further development wherein the base plate of the burner rests movably on bearing elements or respectively contact surfaces which protrude from the inner sides of the shanks of the inner shell.

If in the intermediate space between the outer and the inner shell, baffle plates are arranged one behind the other, in a distributed form over the periphery, each extending alternately at different heights from an upper or a lower covering plate in the direction of the opposite covering plate, which heights are smaller than a total height between the two covering plates, the advantage of the baffle plate area in the intermediate space is that the hot flue gases are several times re-routed in the form of meanders and therefore an intensive thermal conduction from the flue gases to the outer and inner shell can be achieved.

If a gas burner assembly comprises in a recess of the base plate of the burner a mixture distributing duct, which is held in the recess of the burner base plate and is closed in the direction of the combustion chamber by a nozzle plate provided with nozzle openings, which are distributed over the whole length of the mixture distributing duct, whereby an outlet of a Venturi nozzle arrangement for the production of an air or respectively gas mixture communicates with a front side of the mixture distributing duct and wherein, at least on one longitudinal side of the mixture distributing duct a spoiler is arranged at a distance from the longitudinal side, which forms between the mixture distributing duct and the spoiler an air inlet pipe, whereby a support surface is arranged in alignment with the nozzle plate or respectively projects beyond it, an embodiment on its own of the gas burner assembly according to the invention, if desired, is also advantageous, since the burning process and in particular the flame pattern of the gas flame of the gas burner assembly can be easily adapted to different purposes of use due to the arrangement of additional air inlet pipes.

By adjusting the spoiler by means of a height adjustment device, for example a longitudinal slot arrangement with a turnbuckle valve, whereby the spoiler is vertically adjustable relative to the burner base plate, said spoiler can be used simultaneously as supporting surface for simulating components, which simulate the burning of solid fuels in which case glow is created, and moreover, the air supply can be guided into different height levels of the flames.

A regular flame pattern of the gas burner assembly can be achieved by a further development, wherein an air inlet pipe is arranged on each of the two longitudinal sides of the mixture distributing duct, because approximately the same amount of oxygen can be reserved for the burning process on all sides.

The further development according to which two recesses, preferably running parallel to each other are arranged in the burner base plate and whereby in each of the two recesses a mixture distributing duct is arranged and wherein, on the longitudinal sides of the mixture distributing ducts facing away from each other, each of the two mixture distributing ducts is associated with an air inlet pipe, achieves that a uniform flame pattern can be created by arranging two mixture distributing ducts running parallel to each other.

A simple regulation of the air which is guided to the flames forming above the nozzle plates can be achieved by another embodiment wherein the spoiler or respectively a holding device of the latter, is positioned by means of a width adjustment device which is adjustable in a direction perpendicular to the longitudinal side of the mixture distributing duct on the burner base plate.

The embodiment wherein an escape velocity of the gas in the Venturi nozzle arrangement adjacent to the door arrangement is less than in the Venturi nozzle arrangement which is further away from the door arrangement, achieves advantageously a flame colour which is commensurate with the comsumption of solid fuels, for example yellow flames.

Finally, the embodiment wherein a distance of the air inlet pipe adjacent to the door arrangement is smaller than a distance of the air inlet pipe which is further away from the door arrangement, is also advantageous, since the flame formation commensurate with the consumption of the solid fuel occurs at the side of the combustion chamber facing towards the viewer.

BRIEF DESCRIPTION OF THE DRAWINGS

The invention is explained hereinafter in further detail by means of the examplary embodiments illustrated in the drawings, in which.

DETAILED DESCRIPTION OF PREFERRED EMBODIMENTS

Figure 1:
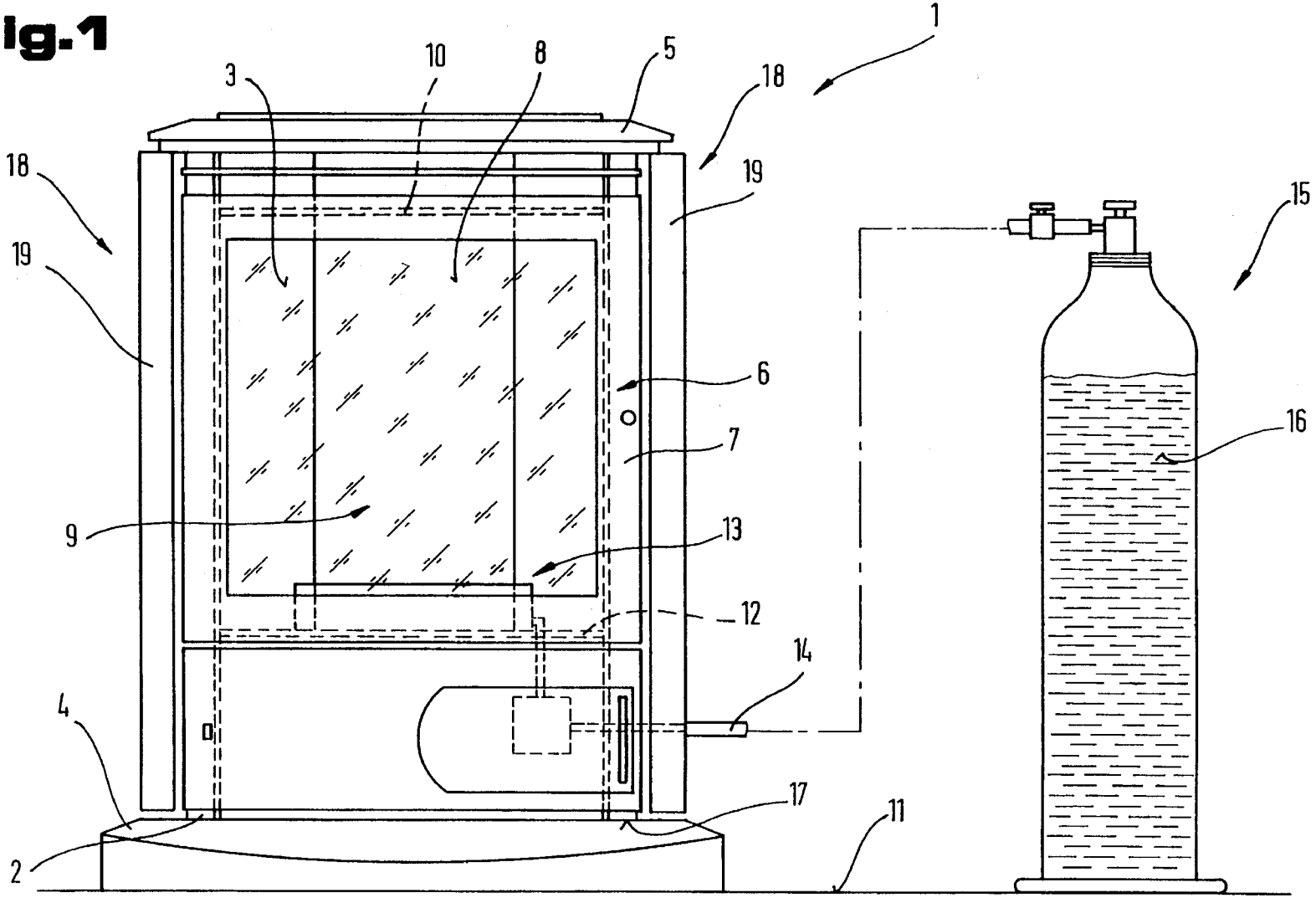
FIG. 1 is a front view, in a simplified diagrammatic representation, of a heating device in accordance with the invention having a cylinder for liquefied gas to feed the gas burner assembly.

FIG. 1 shows a heating device 1 comprising an outer shell 2 and an inner shell 3, a floor plate 4 and a covering plate 5. A combustion chamber 9 is arranged behind a door arrangement 6 with a swinging door 7 in which a viewing window 8 is installed The combustion chamber 9 is bordered towards the top by a covering plate 10 and in the direction of the supporting surface 11 of the floor plate 4 by a burner base plate 12. On the burner base plate 12, a gas burning device 13 is arranged, which is connected by means of an appropriate control and adjusting device or a pressure reducing valve or the like, to a supply pipe 14 of a cylinder 15 for liquefied gas 16. The floor plate 4 consists preferably of a casting which supports on its front side 17 at least the profile with the C-shaped or U-shaped cross-section forming the outer shell 2. The outer shell 2 and the inner shell 3 consist preferably of bent single rolled sheet cuttings as will be described in greater detail hereinafter.

The covering plate 5 can also consist of an appropriately formed casting or a combination of a casting and a ceramic part embedded therein.

Upstream of the outer shell 2, at a distance therefrom, next to the side walls 18 of the heating device 1, sheet metal sheetings 19 or ceramic sheetings, such as tiles or the like are arranged.

Figure 2:
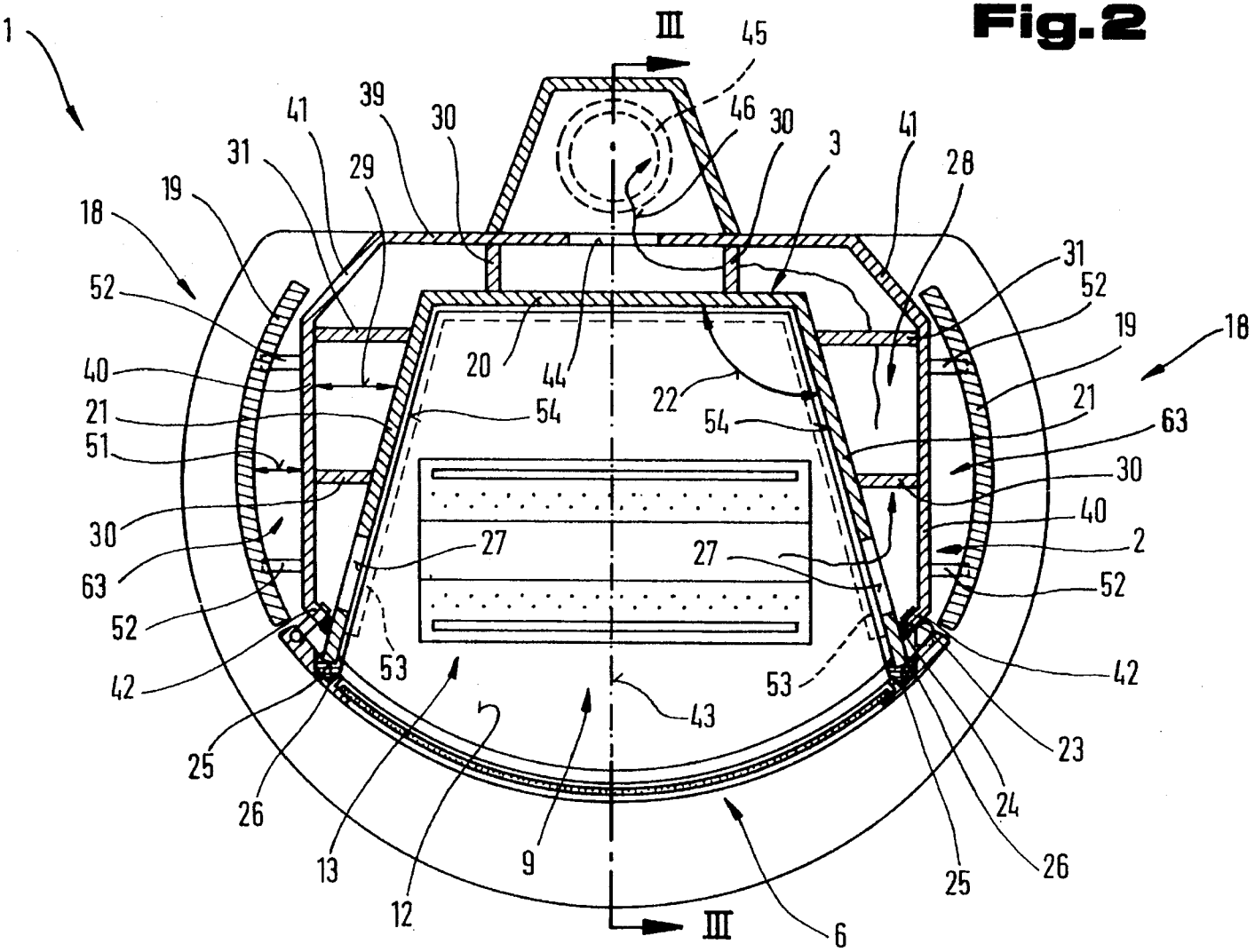
FIG. 2 shows the heating device in accordance with the invention, in top view, in a section taken along the lines II—II in FIG. 3 and in a simplified diagrammatic representation.
Figure 3:
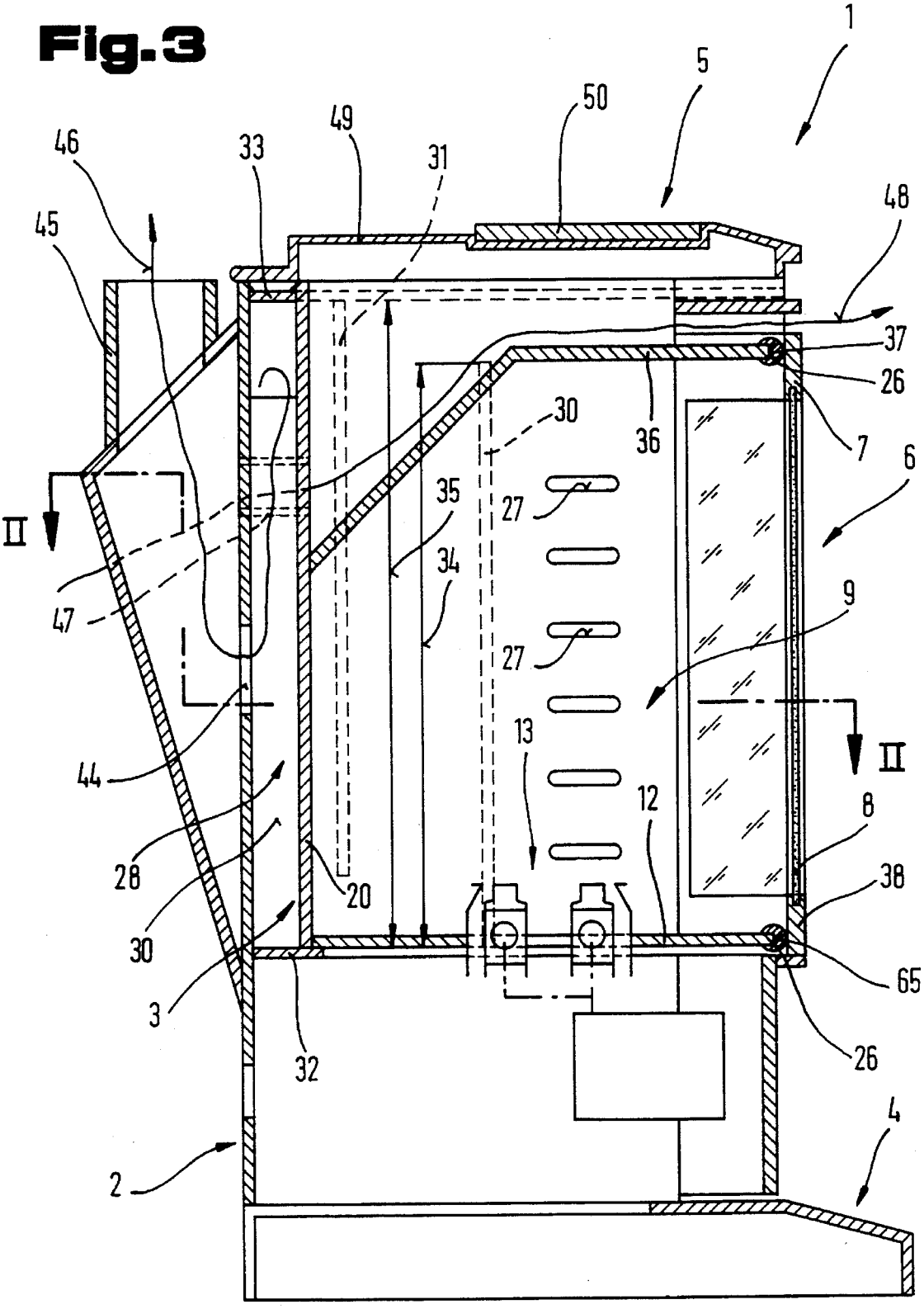
FIG. 3 shows the heating device according to FIG. 2, in side view, in a section taken along the lines III—III in FIG. 2.

As can be seen better in FIGS. 2 and 3, the inner shell 3 is formed by a profile, in the present example a bent single rolled sheet cutting, which has a substantially U-shaped cross-section, whereby an angle 22 which is enclosed by a base 20 and shanks 21, is greater than 90°. Longitudinal front edges 23 of the outer shell 2 are fused with this inner shell 3 by means of a weld 24.

The weld 24 is arranged between a sealing device 26, encompassing a longitudinal front edge 25 of the shanks 21 of the inner shell 3, and admission openings 27, which connect the combustion chamber 9 and the intermediate space 28 between the inner shell 3 and the outer shell 2 to one another. This intermediate space 28 is obtained through the outer and inner shells, 2 or respectively 3, by arranging them at an average distance 29 from one another. This distance 29, for instance, is achieved by the baffle plates 30, 31, which, as can be seen better in FIG. 3, extend alternately from a bottom covering plate 32 in the direction of a top covering plate 33, or baffle plates 31, which extend from the top covering plate 33 towards the bottom covering plate 32, whereby a height 34 of these baffle plates 30, 31 is less than a total height 35 between the bottom and the top covering plates 32, 33.

The combustion chamber 9, as can also be seen best in FIG. 3, is bordered towards the covering plate 5 by a covering sheet metal 36 which has a bent course and extends from the base 20 of the inner shell 3 up into the region of the door arrangement 6. A sealing device 26, which abuts the door 7 of the door arrangement 6, is pushed over a leading edge 37 of this covering sheet metal 36.

In the same manner the burner base plate 12 is also provided with a sealing device 26 on the side facing towards the door arrangement 6.

The frame 38 of the door arrangement 6 abuts this sealing device 26 and therefore, a tight seal of the combustion chamber 9 is formed. Into the frame 38, the viewing window 8 is inserted. The latter can consist of a high temperature, transparent glass plate.

The profile, which is approximately C-shaped and forms the outer shell 2, can also consist of a one-piece, bent single rolled sheet cutting, for example. However, it is also possible to put several profiles together which consist of bent single rolled sheet cuttings, in order to form the outer shell 2. The outer shell 2 has a base 39 and also shanks 40, which are connected to transition pieces 41 which are inclined to these shanks. Extensions 42 are arranged which protrude in the direction of the inner shell 3.

In the present case, the outer shell 2 and the inner shell 3 are arranged symmetrically to a symmetrical axis 43.

In this embodiment, the intermediate space 28 forms a flow path for flue gases which develop during the burning of gases that flow out of the gas burner assembly 13 and enter the intermediate space 28 through the admission openings 27 and which are thereby several times diverted by the baffle plates 30, 31 until they reach a flue outlet 44, which is connected to a smoke pipe connection piece 45 as indicated schematically by arrows 46.

To ensure aeration of the air space above the covering sheet metal 36 and thereby prevent overheating of this covering sheet metal 36, it is possible to arrange a few passages 47 crossing the intermediate space 28 so that the convection air can pass through as indicated by arrows 48.

Furthermore, it can be seen better from the illustration in FIG. 3, that the covering plate 5, which, for instance, consists of a casting 49 and a ceramic part 50 embedded therein, is put on the outer shell 2. The outer shell 2 stands practically on the floor plate 4 which is made of cast iron.

In order to obtain good thermal conduction, in particular between the outer shell 2 and the surrounding room air or respectively the so-called convection air, a sheeting 19 is arranged upstream of each of the shanks 40 in the vicinity of the side walls 18 of the heating device 1 at a distance 51 therefrom. These sheetings 19 can consist of adequate one-piece or several- piece sheet metal parts or ceramic elements such as decorative tiles for example.

In this exemplary embodiment, these sheetings 19 are held in a laterally and vertically adjustable manner by holding devices 52, for example by brackets which are secured to the outer shell 2. Whilst the sheeting 19 in this exemplary embodiment extend only over a partial region of the transition pieces 41, they can of course also extend up into the region of the base 39 of the outer shell 2.

For vertical guidance the burner base plate 12 is put on supports 53, which are secured to an inner side 54 of the shanks 21 of the inner shell 3. These supports can also be formed by the protruding bottom covering plates 32.

This embodiment makes it possible to create in a simple manner an easily accessible room in the area of the gas burner assembly 13, which facilitates the maintenance and servicing of the gas burner assembly 13. At the same time, adequate safety regulations can be adhered to in a simple way, since the burner base plate 12 can be losely inserted into the combustion chamber 9 and sufficient air can be supplied from the region of the floor plate 4 in the direction of the combustion chamber 9.

It is advantageous, that the combustion chamber 9 can be firmly closed towards the side of the viewer by means of a viewing window 8, whereby with a closed door arrangement 6, the impression of an open fire can be created if simulating logs consisting of heat resisting materials are piled up on the gas burners.

Figure 4:
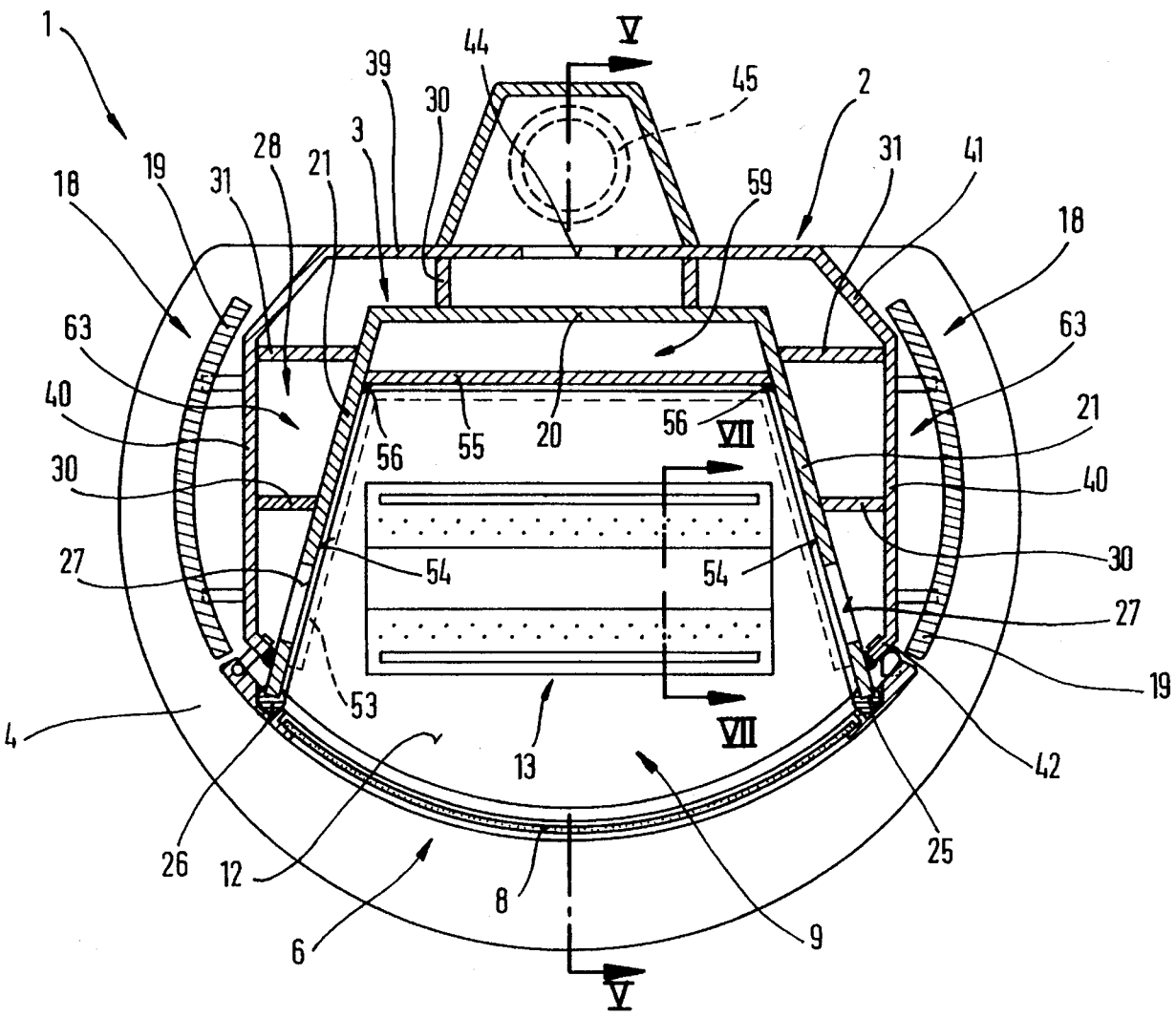
FIG. 4 is a top view of another embodiment of a heating device in accordance with the invention, in top view, in a section taken along the lines IV—IV in FIG. 5.
Figure 5:
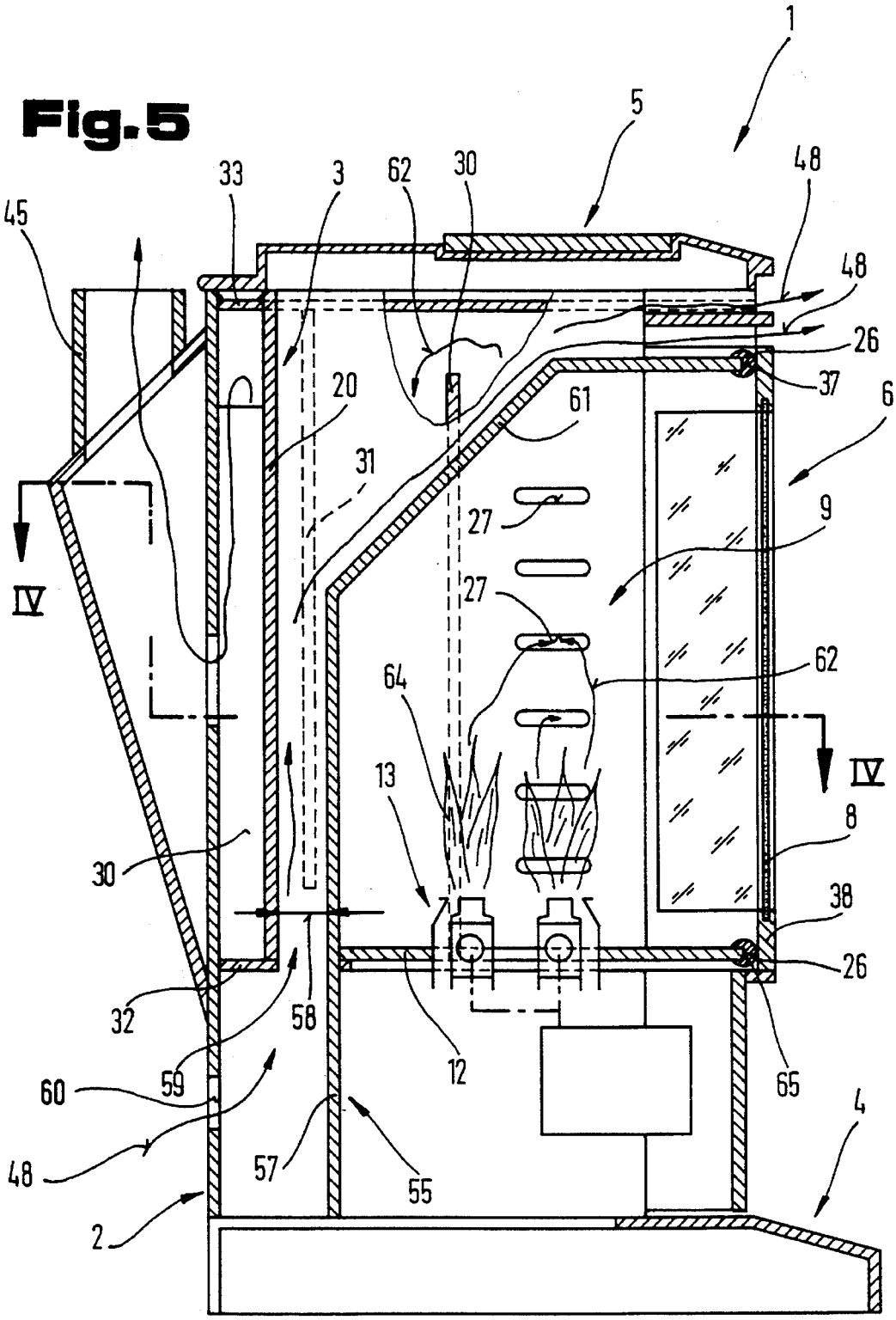
FIG. 5 shows the heating device according to FIG. 4, in side view, in a section taken along the lines V—V in FIG. 4.

FIGS. 4 and 5 show another embodiment for the formation of a combustion chamber 9 of the heating device 1. For the remaining parts, which correspond to those of the heating device described in FIGS. 2 and 3, the same reference numbers have therefore been applied.

This embodiment of the heating device 1 is different from the one illustrated in FIGS. 2 and 3 in that a separating profile 55 with a substantially L-shaped cross-section is inserted in the inner shell 3. This separating profile 55 is inserted between the inner side 54 of the shanks 21 of the inner shell 3 and fused with these shanks 21 in a fume-tight manner by means of welds 56.

Thereby, a first shank 57 runs approximately parallel to the base 20 of the inner shell 3, is however, arranged upstream thereof at a distance 58 in the direction of the combustion chamber 9. Hence, a convection vault 59 is created between the base 20 of the inner shell 3 and the first shank 57, through which convection air can flow, as indicated by arrows 48, which can enter the convection vault 59 via an opening 60 in the outer shell 2, for example. After having passed the first shank 57, the upward flowing convection air passes along a second shank 61 and is redirected by the covering plate 5 towards the door arrangement 6, above which the heated air escapes into the room air in accordance with arrows 48.

Thereby, a double thermal conduction between the combustion chamber 9 and the smoke pipe connection piece 45 is achieved since heat energy can first be rerouted via the separating profile 55 to the convection air—according to arrows 48—which passes through the convection vault 59, whereby the air flowing through the convection vault 59 can be heated at the same time by the radiation of the inner shell 3.

On the other hand, the flue gases, which enter according to arrows 62 through the admission openings 27 are several times diverted in the form of meanders by the baffle plates 30, 31, so that also between the air passing through the convection vault 59, according to arrow 48, an intensive thermal conduction is occurring along the inner shell 3. This takes also place between the outer shell 2 and the sheeting 19 in the region of the convection channels 63.

Thus, the high heating capacity that is the large amount of heat which is created by the flames 64 when burning gaseous fuels, can be transferred with lower efficiency rate losses to the room air to be heated.

Simultaneously, excessive strain on the chimney is prevented through multiple redirection and cooling of the flue gases and at the same time a complete consumption and better exhaust values can be achieved.

Moreover, it can be seen from the illustration, in particular in FIG. 5, that the sealing device 26 is pushed over a front edge 65 of the burner base plate 12 as well as over a front edge 37 of the second shank 61 of the separating profile 55, whereby said sealing device together with the frame 38 of the door arrangement 6 lead to a sealing of the combustion chamber 9 with respect to the ambient air, which provides for a full view of the flame development inside the combustion chamber 9 through the viewing window 8.

As can be seen further from this illustration, in particular with regard to the bottom and the top covering plates 32 and 33, they are not fused flush with the front edges of the adjacent sheet metal profiles but are somewhat offset inwardly with respect to the front edges, so that the welds can be formed as fillet welds, which are easier and safer to produce, instead of butt welds.

Figure 6:
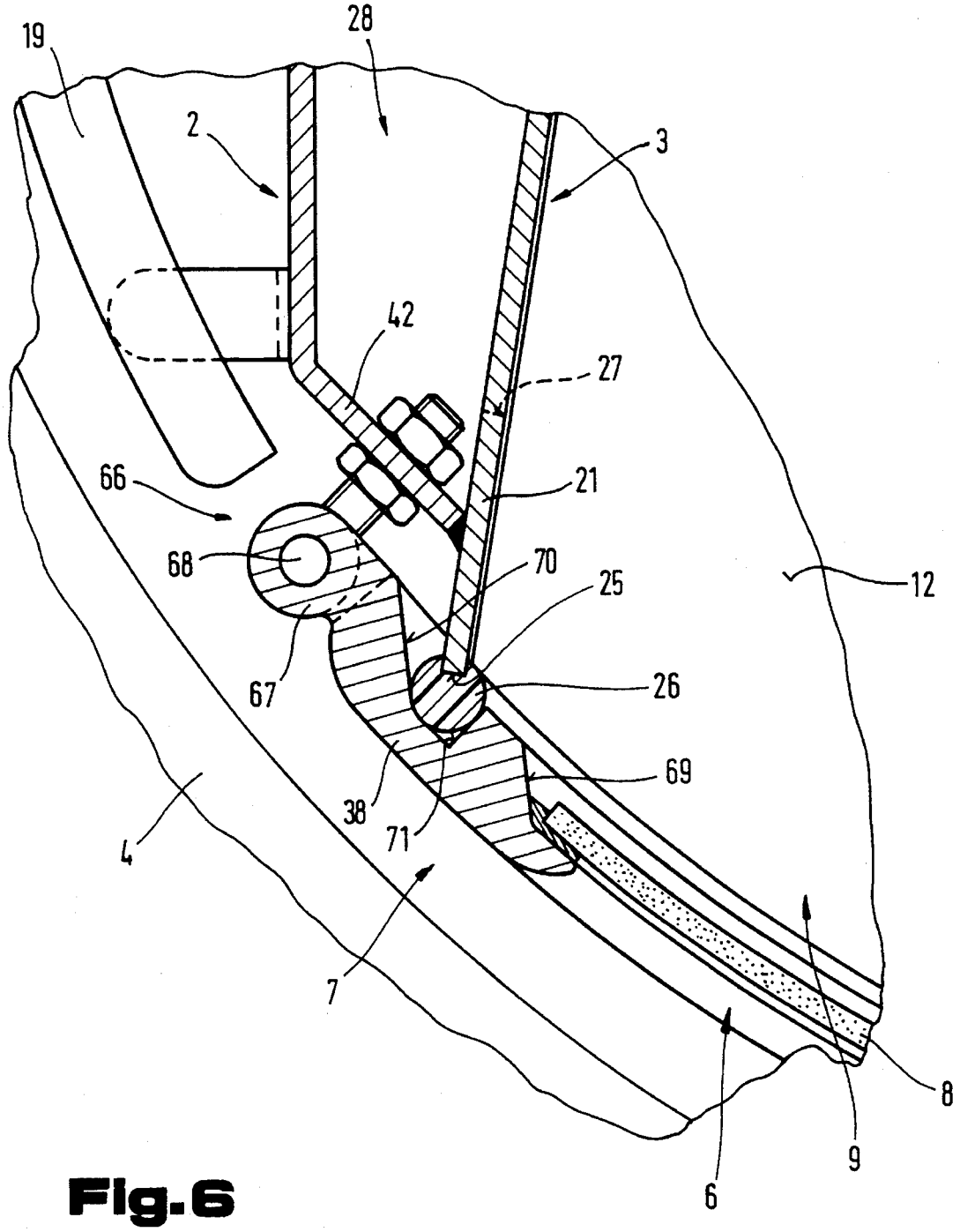
FIG. 6 is a top view, partially cut, and in a simplified diagrammatic representation of the arrangement of the sealing device and the bearing device for the door arrangement in the connecting area between the outer and the inner shell.

FIG. 6 shows a bearing device 66 for the door 7 of the door arrangement 6 in detail. The frame 38 of the door 7 comprises a door hinge 67 which is located on the swivel pin 68 in a rotatable manner.

The swivel pin 68 is secured to the flange-like extension 42 of the outer shell 2 by fastening elements, such as screws or the like.

Furthermore, it is apparent from this illustration, that the viewing window 8 is inserted in a recess 69 of the frame 38 of the door arrangement 6 from the side of the combustion chamber 9, that is to say from the inside.

In addition, the frame 38 has a circular recess 70, which, in the direction of the viewing window 8 is limited by a contact surface 71.

A sealing device 26, which is put onto the appropriate front edges 25 or respectively leading edges of the shanks 21 of the inner shell 3 or respectively the separating profile 55 of the covering sheet metal 36 or the burner base plate 12, engages into this recess 70.

Thus, a more intensive, tighter seal of the combustion chamber 9 is ensured, so that, in addition, the entry of fresh air from the door arrangement 6 is prevented and a satisfying consumption process achieved.

Figure 7:
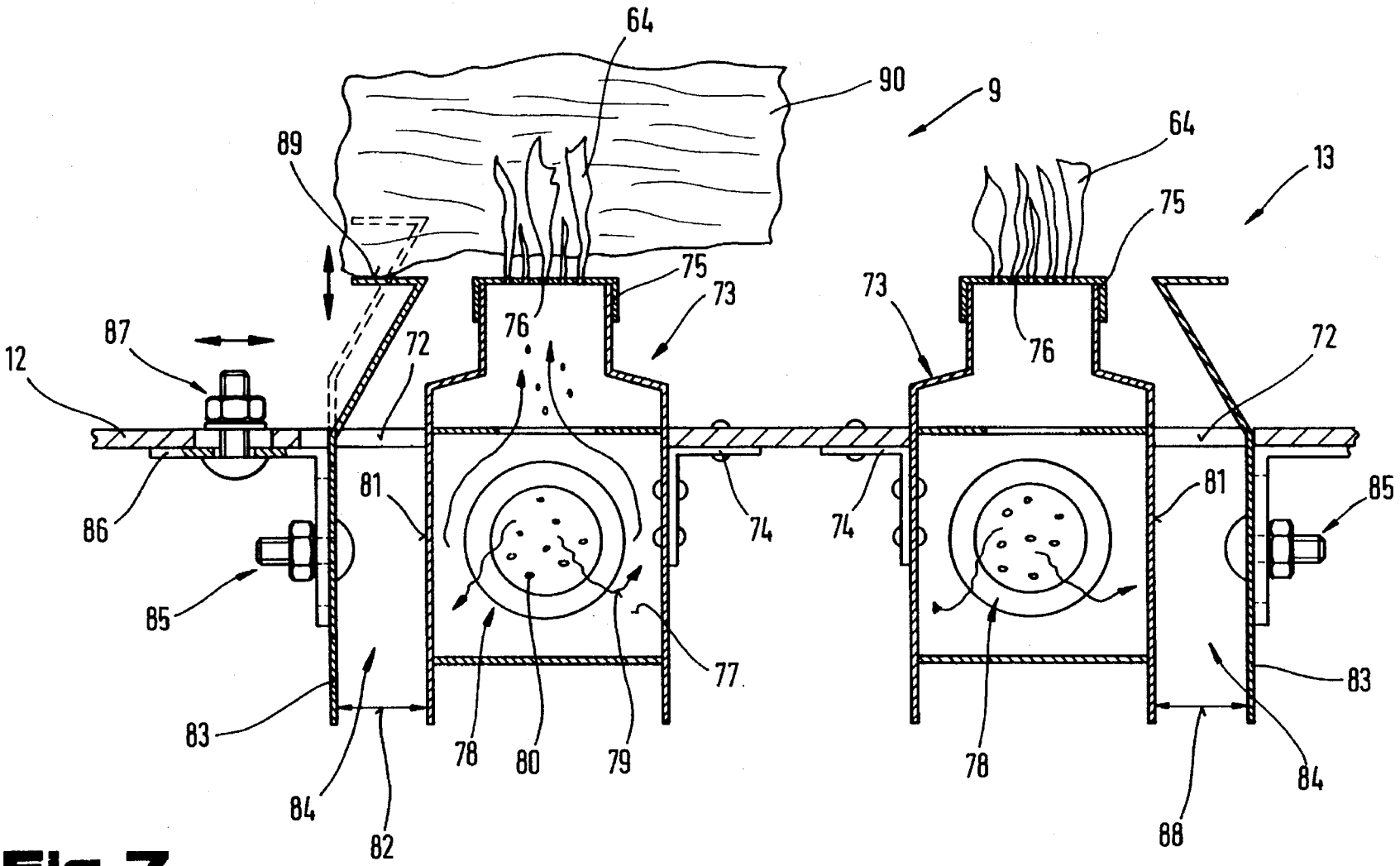
FIG. 7 is a side view of the gas burner assembly of the heating device in accordance with the invention, in a section taken along the lines VII—VII in FIG. 4 and in a greatly simplified diagrammatic representation.

FIG. 7 shows the gas burner assembly 13 at a larger scale. In the present example of an embodiment, it comprises two mixture distributing ducts 73 which are arranged parallel to each other in the recess 72, and are secured to the burner base plate 12, for example by means of angle brackets 74.

In the direction of the combustion chamber 9 the mixture distributing ducts 73 are closed by a nozzle plate 75, in which nozzle openings 76, such as multiple bores in rows and preferably offset to one another, are arranged.

Through a front side 77 of these mixture distributing ducts 73 a mixture of air 79 and gas 80 is supplied via a Venturi nozzle arrangement 78 and distributed over the whole length of the mixture distributing duct, so that it can flow out uniformly via the nozzle openings 76 in the direction of the combustion chamber 9.

To each of these mixture distributing ducts 73 a spoiler 83 is allocated at a distance 82 on the longitudinal sides 81 facing away from one another, which forms between the longitudinal side 81 of the mixture distributing ducts 73 and the spoilers 83 an air inlet pipe 84.

In order to precisely regulate the amount of air supplied to the flames 64 through the air inlet pipes 84, the spoiler 83 can be adjusted vertically with respect to the burner base plate 12 by a height adjustment device 85 as indicated in broken lines.

In addition, it is further possible to mount a holding device 86 on the burner base plate 12 by means of a width adjustment device 87, so that the distance 82 between the longitudinal side 81 of each mixture distributing duct 73 and the spoiler 83 can also be determined in accordance with the desired formation of the flames 64 through an approriate fresh air supply.

It is particularly advantageous if a distance 88 of the mixture distributing duct 73, which is closer to the door arrangement 6, is shorter, so that a smaller amount of air can pass into the region of the nozzle openings 76. This causes the air and gas mixture to burn with a yellow flame whilst the air and gas mixture behind the mixture distributing duct 73 maintains complete combustion developing full flames. This, however, can also be achieved through different adjustments of the two Venturi nozzles to one another. This way, a flame formation similar to the consumption of a solid fuel can be simulated in a simple way.

Furthermore, it is also apparent from this exemplary embodiment that the spoilers 83 are provided with support areas 89 on their upper sides facing the combustion chamber 9, on which heat resisting logs simulating decorative pieces 90 can be placed. Such decorative pieces 90 can be constructed in such a way that they start to glow under the load of the flames 64 and give the impression of burning through red heat development.

This way, an appropriate outside impression of a heating device 1 burning solid fuels is given and also a burning that is low in harmful substances can be achieved by using gaseous fuels.

Figure 8:
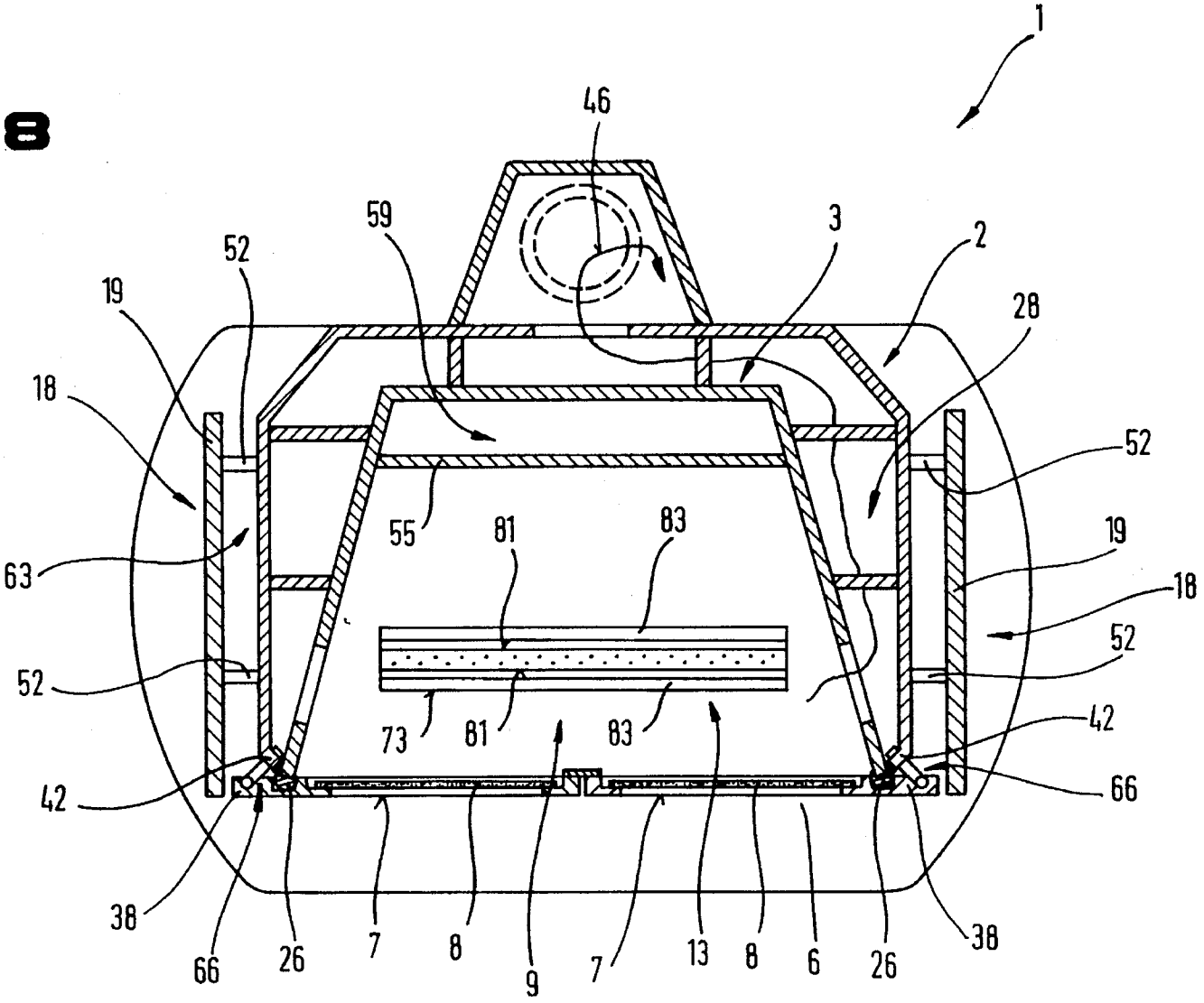
FIG. 8 is a top view of another embodiment of the heating device in accordance with the invention, in section, and in a simplified diagrammatic representation.

FIG. 8 is a top view of another embodiment of a heating device 1, which, in its basic design corresponds to the heating device shown in FIGS. 2 and 3.

Accordingly, the heating device 1 consists of an outer shell 2, an inner shell 3 and an intermediate chamber 28 enclosed therebetween, through which the flue gases—arrow 46—are flowing through.

Furthermore, in the combustion chamber 9 a separating profile 55 is arranged, which forms between the inner shell 3 and the separating profile 55 a convection vault 59 for the room air to be heated.

In this embodiment a gas burner assembly 13 which has only one mixture distributing duct 73, is built into the combustion chamber 9. Arranged upstream of said distribution channel in the region of its two longitudinal sides 81 spoilers 83 are arranged, so that a uniform flame pattern with vertical flames can be achieved and also a burning without harmful substances due to the oxygen which is supplied from all sides by the air.

As can be seen, the outer shell 2 and the inner shell 3 have essentially the same cross-sectional form as the embodiment shown in FIG. 2. Simply through the design of the sheeting 19 a stove can be produced with the same holding devices 52, which outwardly is rectangular or if desired, also square. The advantage of this embodiment is that a convection channel 63 is created between the outer shell 2 and the sheeting 19, which presents a uniform width over the entire length of the side walls 18 of the heating device 1 and thereby a uniform passage cross-section.

Equally, it is shown that the door arrangement 6 may also consist of two doors 7, i.e. of a double wing door 7. In spite of this, the advantage of sealing with the sealing device 26 can be maintained in the region of the door frames 38 and also the arrangement of the bearing device 66 on the extensions 42 of the outer shell 2.

It is of course possible to install viewing windows 8 in the doors 7. To hold and close the doors 7 any desired closing devices, such as levers, rotary type buttons, turnable hooks or the like, can be used, which are known from prior art and not shown in detail in the present or other examples of the embodiment.

Therefore, this construction principle achieves advantageously that the basic construction of such a heating device 1 can be the same for a large piece number of heating devices 1 and that in spite of this, a big variety of configurations with respect to appearance or design is feasible with no additional costs.

Finally, it should be indicated that for improved understanding of the solution in accordance with the invention, the individual components or structural component are presented in a distorted manner, unproportionally and untrue to scale.

However, individual embodiments can also form their own solutions in accordance with the invention, in particular by using spoilers 83 for the construction of the gas burner assembly 13 and the configuration of the air inlet pipes 84 and also the arrangement of sealing devices 26 and the air guide system of the convection air and the flue gases.

In particular, the individual embodiments presented in FIGS. 1, 2, 3; 4, 5; 6; 7; 8 can be subjected to form their own solutions in accordance with the invention. Related tasks and solutions in accordance with the invention are apparent from the detailed descriptions of these figures.

What is claimed is:

1. A heating device for burning gaseous fuels, which comprises (a) a floor plate having a supporting surface, (b) an outer shell resting on the supporting surface of the floor plate and having a longitudinal axis extending perpendicularly to the supporting surface, the outer shell consisting of (1) a base and (2) two shanks projecting from the base, the shanks having end edges, (c) an inner shell consisting of (1) a base and (2) two shanks projecting from the base, the shanks having end edges defining therebetween an open space opposite the base, (3) the end edges of the outer and inner shell shanks being fixedly connected to each other, and (4) the base and shanks of the inner shell defining a combustion chamber, (d) the inner shell base being spaced from the outer shell base and the inner shell shanks being spaced from the outer shell shanks in a direction extending perpendicularly from the outer shell base and shanks, respectively, to define an intermediate space therebetween, (1) the inner shell shanks having openings through which the combustion chamber is in communication with the intermediate space, (e) a plate opposite the floor plate and covering the outer and inner shells, (f) a door arrangement for closing the open space, (g) a burner base plate mounted on the inner shell and carrying a gaseous fuel burner assembly, (h) a covering sheet metal element over the combustion chamber, (i) a smoke pipe connection piece in communication with the intermediate space through a flue gas outlet in the region of the covering sheet metal element whereby the intermediate space defines a flue gas passage between the shank openings and the flue gas outlet, and (j) sheet elements arranged around the shanks of the outer shell and defining a convection channel therebetween.

2. Heating device of claim 1, wherein the covering sheet metal is formed by a second shank of an L-shaped separating profile, the first shank of which is inserted between the shanks of the inner shell at a spacing from the base of the inner shell on the opposite side of the base of the outer shell and connected in a smoke-tight manner to the shanks of the inner shell via a weld and extending downwardly in the direction of the floor plate at least into the region of the burner base plate.

3. Heating device of claim 2, wherein between the first shank of the separating profile and the base of the inner shell, which are running parallel to each other, a convection vault is formed, which leads into a further convection vault between the other shank of the separating profile and a covering plate arranged at a distance thereabove.

4. Heating device of claim 2, wherein a front edge associated with the door arrangement of the second shank of the L-shaped separating profile and the longitudinal front edges of the shanks of the inner shell and also, a front edge of the burner base plate have a sealing device and allocated to these sealing devices a circumferential contact surface of a frame of the door arrangement.

5. Heating device of claims 1, wherein the base and the shanks of the outer shell are connected by transition pieces extending diagonally to them.

6. Heating device of claim 1, wherein at the extremities of the shanks facing away from the base in the direction of the longitudinal axis of the outer shell, extensions are arranged, facing one another and running inclined to said extremities, and which are preferably formed onto the outer shell in one piece.

7. Heating device of claim 6, wherein the door arrangement comprises a swinging door having a frame pivotal about an axis and a bearing for the axis, the axis being secured to the extensions.

8. Heating device of claim 1, wherein the frame comprises a receiving flange for a heat resisting viewing window.

9. Heating device of claim 1, wherein holding devices are arranged on the outer shell at a distance from the shanks of the outer shell in order to secure the sheetings and that the air space between the sheet elements.

10. Heating device of claim 1, wherein the covering plate projects beyond the sheet elements on the side facing away from the outer shell.

11. Heating device of claim 1, wherein in the intermediate space between the outer and the inner shell, baffle plates are arranged one behind the other, in a distributed form over the periphery, each extending alternately at different heights from an upper or a lower covering plate in the direction of the opposite covering plate, which heights are smaller than a total height between the two covering plates.

12. Heating device of claim 1, wherein the gas burner assembly comprises in a recess of the base plate of the burner a mixture distributing duct, which is held in the recess of the burner base plate and is closed in the direction of the combustion chamber by a nozzle plate provided with nozzle openings, which are distributed over the whole length of the mixture distributing duct, whereby an outlet of a Venturi nozzle arrangement for the production of an air or respectively gas mixture communicates with a front side of the mixture distributing duct and and wherein, at least on one longitudinal side of the mixture distributing duct a spoiler is arranged at a distance from the longitudinal side, which forms between the mixture distributing duct and the spoiler an air inlet pipe, whereby a support surface is arranged in alignment with the nozzle plate or respectively projects beyond it.

13. Heating device of claim 12, wherein the spoiler by means of a height adjustment device, for example a longitudinal slot arrangement with a turnbuckle valve, is vertically adjustable relative to the burner base plate.

14. Heating device of claim 12, wherein an air inlet pipe is arranged on each of the two longitudinal sides of the mixture distributing duct.

15. Heating device of claim 12, wherein the spoiler is positioned by means of a width adjustment device which is adjustable in a direction vertical to the longitudinal side of the mixture distributing duct on the burner base plate.

16. Heating device of claim 12, wherein an escape velocity of the gas in the Venturi nozzle arrangement adjacent to the door arrangement is less than in the Venturi nozzle arrangement which is further away from the door arrangement.

17. Heating device of claim 12, wherein a distance of the air inlet pipe adjacent to the door arrangement is smaller than a distance of the air inlet pipe which is further away from the door arrangement.

18. Heating device of claim 1, wherein two recesses running parallel to each other are arranged in the burner base plate and whereby in each of the two recesses a mixture distributing duct is arranged and wherein, on the longitudinal sides of the mixture distributing ducts facing away from each other, each of the two mixture distributing ducts are associated with an air inlet pipe.

19. Heating device of claim 1, comprising support ledges projecting from an inner surface of the shanks of the inner shell, and the burner base plate being displaceably mounted on the support ledges.

* * * * *